US007862296B2

(12) United States Patent
Finneran et al.

(10) Patent No.: US 7,862,296 B2
(45) Date of Patent: Jan. 4, 2011

(54) TURBINE VANE SECURING MECHANISM

(75) Inventors: John W. Finneran, Palm Beach Gardens, FL (US); Jeffery W. Samuelson, Jupiter, FL (US); Richard C. Charron, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 802 days.

(21) Appl. No.: 11/844,778

(22) Filed: Aug. 24, 2007

(65) Prior Publication Data

US 2009/0053056 A1 Feb. 26, 2009

(51) Int. Cl.
*F03B 3/14* (2006.01)

(52) U.S. Cl. ..... 415/209.3; 416/220 R; 416/500

(58) Field of Classification Search ..... 415/208.1, 415/208.2, 209.2; 416/219 R, 220, 248, 416/500

See application file for complete search history.

(56) References Cited

U.S. PATENT DOCUMENTS

| | | | | |
|---|---|---|---|---|
| 2,622,790 | A | 12/1952 | McLeod | |
| 2,801,822 | A | 8/1957 | Speed | |
| 2,957,228 | A | 10/1960 | Stoddard et al. | |
| 3,303,992 | A | 2/1967 | Johnson | |
| 3,990,810 | A | 11/1976 | Amos et al. | |
| 5,024,580 | A | 6/1991 | Olive | |
| 5,211,537 | A | 5/1993 | Langston et al. | |
| 5,328,327 | A | 7/1994 | Naudet | |
| 5,584,659 | A * | 12/1996 | Schmidt | 416/221 |
| 5,628,617 | A | 5/1997 | Dalton et al. | |
| 6,213,719 | B1 | 4/2001 | Violette et al. | |
| 6,234,756 | B1 | 5/2001 | Ress, Jr. et al. | |
| 6,575,704 | B1 * | 6/2003 | Tiemann | 416/219 R |
| 6,676,080 | B2 | 1/2004 | Violette | |
| 6,837,686 | B2 | 1/2005 | Di Paola et al. | |
| 7,198,463 | B2 | 4/2007 | Kanebako et al. | |

FOREIGN PATENT DOCUMENTS

| | | |
|---|---|---|
| EP | 0331837 A1 | 9/1989 |
| JP | 61-215490 | 9/1986 |
| JP | 11-336698 | 12/1999 |
| JP | 2005-003302 | 1/2005 |
| WO | WO 2004/029417 A1 | 4/2004 |

* cited by examiner

*Primary Examiner*—Igor Kershteyn

(57) ABSTRACT

A turbine vane attachment system configured to eliminate movement of a turbine vane relative to a turbine vane carrier. The turbine vane attachment system may include a base attached to a turbine airfoil. The base may be configured to contact a wedge support along a plane that is generally non-parallel and nonorthogonal with a longitudinal axis of the airfoil. A bolt may connect the base with the wedge support. The bolt may change a distance between a channel in the base and an outer bearing surface. The turbine vane may be positioned in a vane carrier such that tongues extending from the vane carrier are positioned in the channels. As the bolt is advanced, the wedge support is moved laterally along the support surface of the base and the channels engage the tongues, thereby preventing movement of the turbine vane.

15 Claims, 4 Drawing Sheets

TURBINE VANE SECURING MECHANISM

FIELD OF THE INVENTION

This invention is directed generally to stationary turbine vanes, and more particularly to turbine vane attachment systems.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are formed from inner and outer endwalls attached to an airfoil extending therebetween. The endwalls are typically attached to an turbine vane carrier via tongue and groove configurations. In particular, channels within the endwalls of the vanes receive protrusions extending from the turbine vane carriers to support the vanes. However, there typically exists looseness between the protrusions and sidewalls of the grooves allowing for the turbine vane to vibrate within the attachment system. Such vibration is damaging and thereby reduces the useful life of the turbine vane. In addition, the loose fit allows the turbine vane to move back and forth, which creates wear as well. Thus, a need exists for a tighter connection between turbine vanes and turbine vane carriers.

SUMMARY OF THE INVENTION

This invention relates to a turbine vane attachment system configured to eliminate movement of a turbine vane relative to a turbine vane carrier during turbine engine operation. The turbine vane attachment system is usable with turbine vanes in the turbine and compressor sections of a turbine engine. The turbine vane attachment system may include a base attached to a turbine airfoil. The base may be configured to contact a wedge support along a plane that is generally nonparallel and nonorthogonal with a longitudinal axis of the airfoil. A connection system, such as, but not limited to, a bolt may connect the base with the wedge support. As the bolt is advanced, a distance between a channel in the base and an outer bearing surface increases. The turbine vane may be positioned in a vane carrier such that tongues extending from the vane carrier are positioned in the channels. As the bolt is advanced, the wedge support is moved laterally along a support surface of the base causes the channels to move radially and engage the tongues, thereby preventing movement of the turbine vane.

The turbine vane may be formed from a generally elongated airfoil formed from an outer wall, and having a leading edge, a trailing edge, a pressure side, and a suction side, a first endwall at a first end, and a second endwall at a second end opposite the first end. A base may extend radially from the generally elongated airfoil, including an outer surface proximate to the airfoil. The base may also include a first channel extending into a first side of the base that is generally orthogonal to the generally elongated airfoil and a second channel extending into a second side of the base generally opposite to the first side and generally aligned with the first channel. A first flange may be proximate to and aligned with the first channel, and a second flange may be proximate to and aligned with the second channel. A support surface on the base may be radially remote to the generally elongated airfoil and nonparallel to the generally elongated airfoil. A wedge support block may have a contact surface in contact with the support surface of the base and an opposite bearing surface, wherein the contact surface and bearing surface are nonparallel. A protrusion of the wedge support block may be positioned within a groove in the base that extends from a third side of the base between the first and second sides. A connection system may movably engage the wedge support block to the base such that the wedge support block is movable relative to the base, which increases a distance between the outer bearing surface of the base and the channels. Such a configuration causes the wedge support block and base to be fixed tightly to tongues extending from a vane carrier into the first and second channels of the base such that rotation about the connection system is prevented and movement of the turbine airfoil and base relative to the vane carrier is prevented.

In one embodiment, the connection system may be a bolt extending through an orifice in the base and threadably attached in an orifice in the wedge support block. The head of the bolt may be countersunk in the base. The at least one bolt may be positioned on a longitudinal axis of the turbine airfoil. The at least one bolt may be parallel with the support surface of base. The at least one bolt may be positioned at an angle between a longitudinal axis of the at least one bolt and a fourth side of the base that is generally opposite to the third side of the base, wherein the angle is between about ninety four degrees and ninety eight degrees, and in one embodiment, about ninety six degrees. The contact surface of the wedge support block and the protrusion may both contact the base on the support surface and another surface parallel to the support surface.

An advantage of this invention is that the turbine vane attachment system fixedly attaches the turbine vane to the turbine vane carrier to prevent damaging vibration.

Another advantage of this invention is that the turbine vane attachment system fixedly attaches the turbine vane to the turbine vane carrier to prevent movement, and thus prevent wear, of the turbine airfoil by offsetting the channels in the base from the turbine airfoil.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
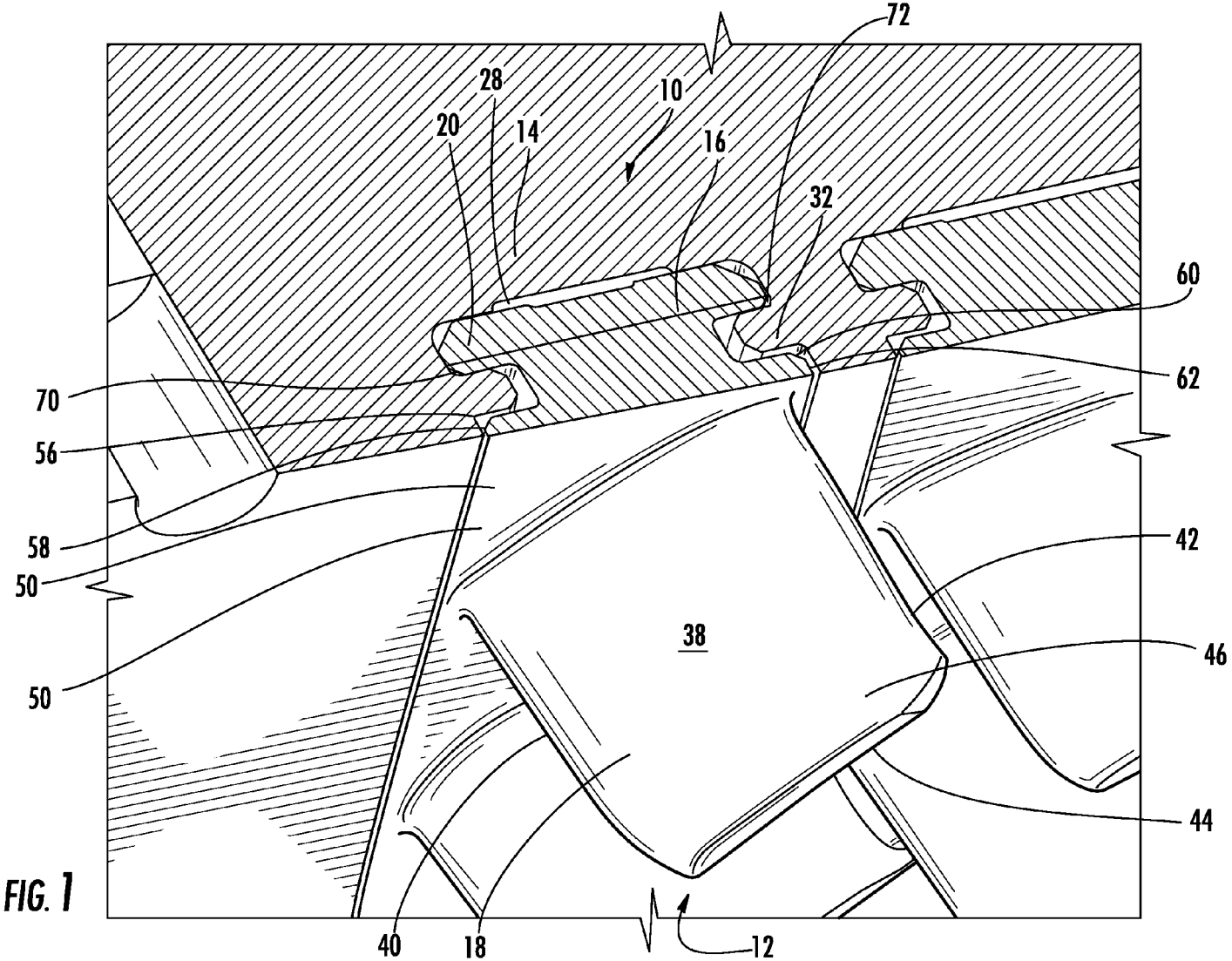
FIG. 1 is a cross-sectional view of turbine vanes with aspects of this invention attached to a vane carrier.

As shown in FIGS. 1-8, this invention is directed to a turbine vane attachment system 10 configured to eliminate movement of a turbine vane 12 relative to a turbine vane carrier 14 during turbine engine operation. The turbine vane attachment system 10 is usable with turbine vanes 12 in the turbine and compressor sections of a turbine engine. The turbine vane attachment system 10 may include a base 16 attached to a turbine airfoil 18. The base 16 may be configured to contact a wedge support 20 along a plane 22 that is generally nonparallel and nonorthogonal with a longitudinal axis 23 of the airfoil 18. A connection system 82, such as, but not limited to, a bolt 24 may connect the base 16 with the wedge support 20. As the bolt 24 is advanced, a distance between a channel 26 in the base 16 and an outer bearing surface 28 increases. The turbine vane 12 may be positioned in a vane carrier 30 such that tongues 32 extending from the vane carrier 30 are positioned in the channels 26. As the bolt 24 is advanced, the wedge support 20 is moved laterally along a support surface 34 of the base 16 and the channels 26 engage the tongues 32, thereby preventing movement of the turbine vane 12.

Figure 3:
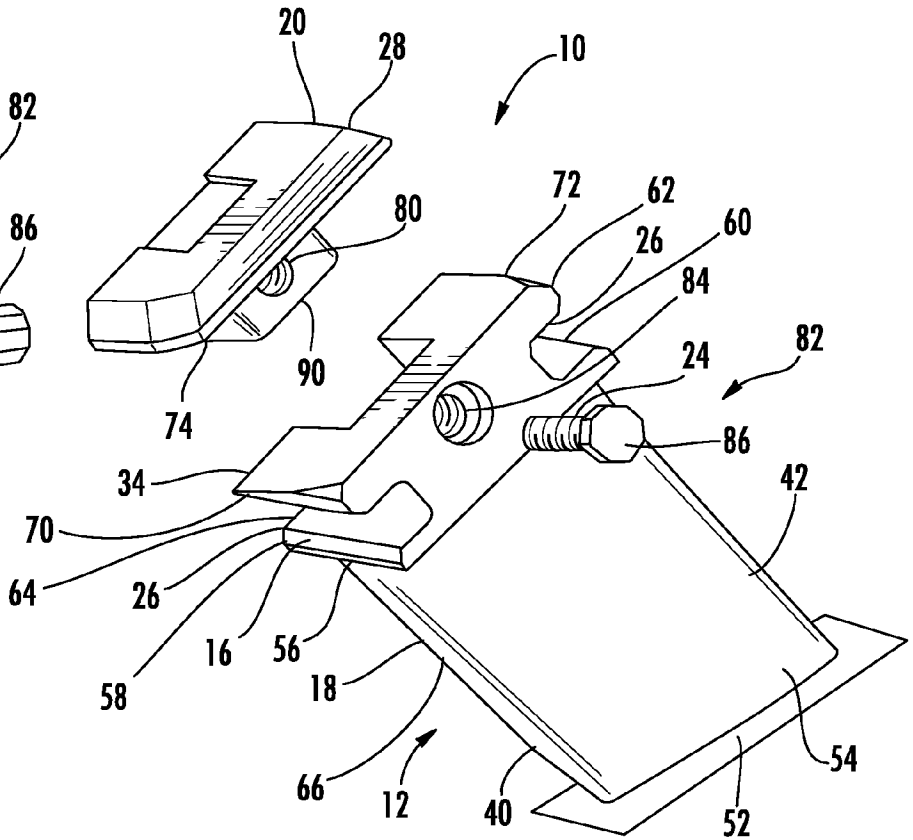
FIG. 3 is an alternative exploded perspective view of a turbine vane of this invention.
Figure 2:
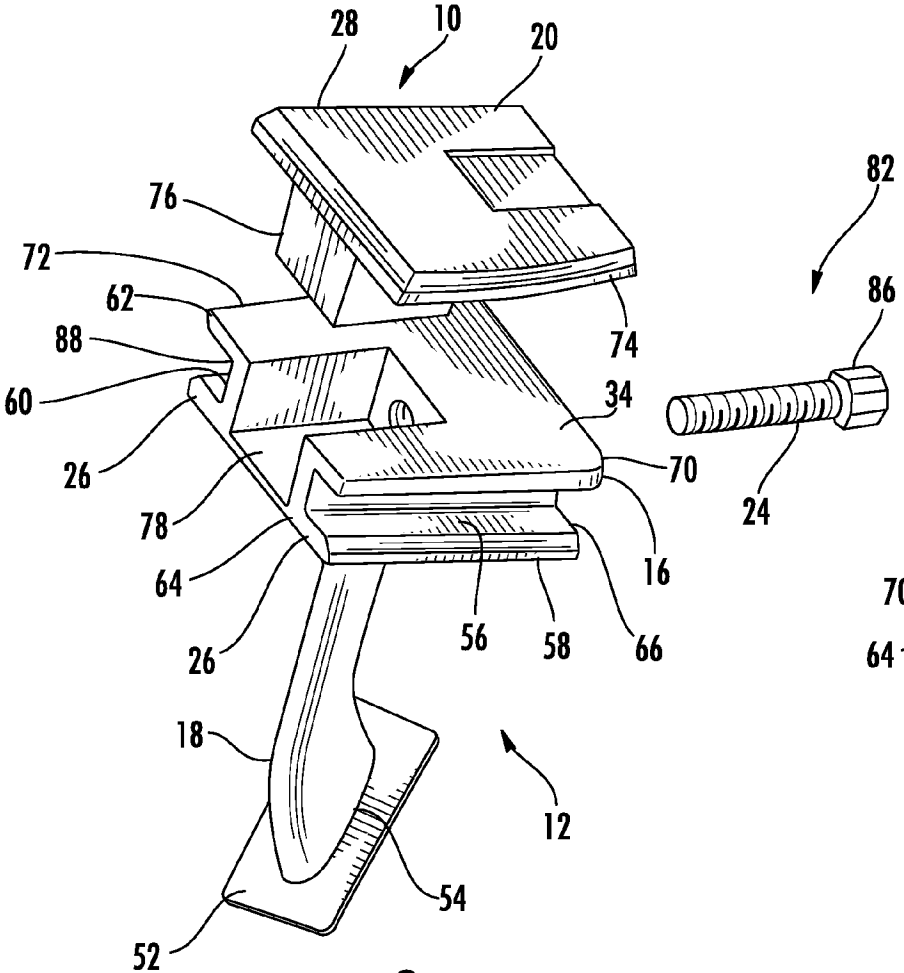
FIG. 2 is an exploded perspective view of a turbine vane of this invention.
Figure 5:
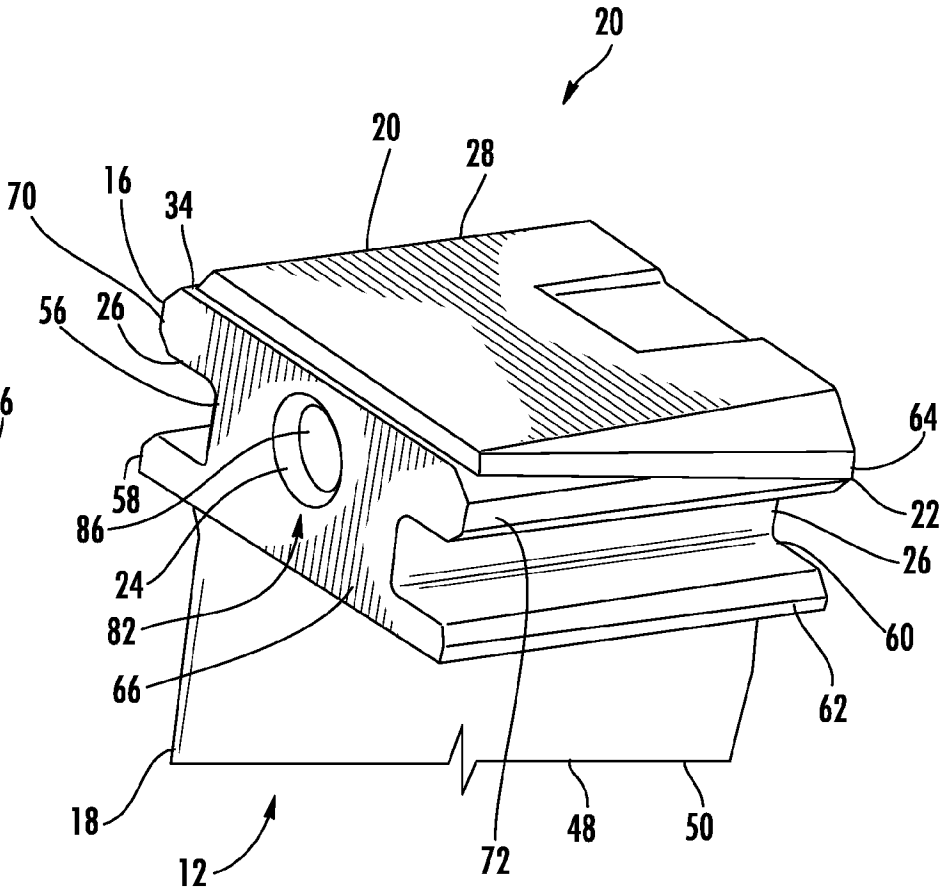
FIG. 5 is an alternative perspective view of a turbine vane of this invention.
Figure 4:
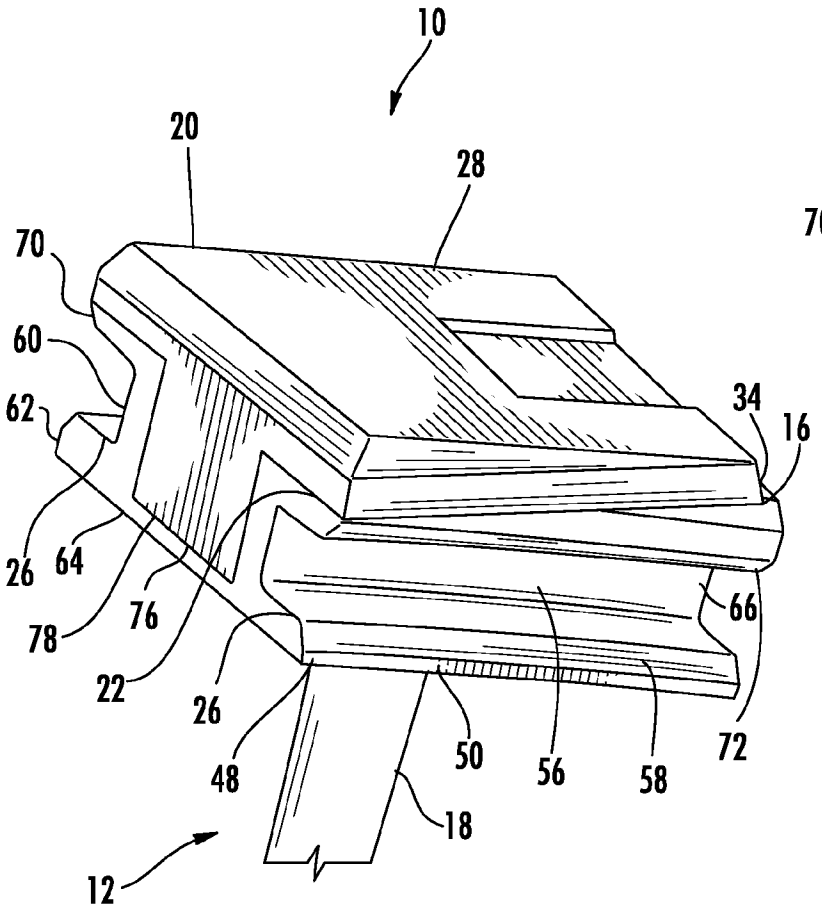
FIG. 4 is a perspective view of a turbine vane of this invention.

As shown in FIGS. 1 and 3, the turbine vane 10 may be formed from a generally elongated airfoil 18 formed from an outer wall 38, and having a leading edge 40, a trailing edge 42, a pressure side 44, a suction side 46, a first endwall 48 at a first end 50, and a second endwall 52 at a second end 54 opposite the first end 50. The generally elongated airfoil 16 may have any appropriate profile configured for use in a turbine engine.

The base 16 may be attached to and formed integrally with the second endwall 52. The base 16 may extend radially from the turbine airfoil 18 and may include one or more channels 26. In at least one embodiment, the base 16 may extend outwardly to be wider than all sides of the turbine airfoil 18, such as wider than the leading edge 40, trailing edge 42, pressure side 44, and suction side 46. In at least one embodiment, the base 16 may include a first channel 56 on a first side 58 of the base 16 and a second channel 60 on a second side 62 of the base 16. The first and second channels 56, 60 may extend generally orthogonal to the longitudinal axis 23 of the airfoil 18 and from a third side 64 of the base 16 to a fourth side 66 of the base 16. The first and second channels 56, 60 may extend into the base 16 a distance sufficient to receive the tongues 32 extending from the turbine vane carrier 14. For instance, in one embodiment, the first and second channels 56, 60 may extend into the base 16 each a distance of about ⅕ of the width of the base 16. The first and second channels 56, 60 may be offset laterally from the turbine airfoil 18. In such a position, the channels 56, 60 and corresponding tongues 32 prevent movement of the turbine airfoil 18 during use. The first channel 56 may form a first flange 70 aligned with and forming a side of the first channel 56, and the second channel 60 may form a second flange 72 aligned with and forming a side of the second channel 60.

The base 16 may include a support surface 34 that is positioned nonparallel and nonorthogonal to the longitudinal axis 23 of the turbine airfoil 18 and is positioned radially remote to the generally elongated airfoil 18. The support surface 34 may be positioned at an angle 96 between about ninety four degrees and ninety eight degrees between a longitudinal axis 68 of the bolt 24 and a fourth side 66 of the base 16 that is generally opposite to the third side 64 of the base 16. In one embodiment, the support surface 34 may be positioned at about ninety six degrees between a longitudinal axis 68 of the bolt 24 and a fourth side 66, of the base 16 that is generally opposite to the third side 64 of the base 16.

The wedge support block 20 may be configured to bear upon the support surface 34 of the base 16. In particular, the wedge support block 20 may include a contact surface 74 in contact with the support surface 34 of the base 16 and an opposite bearing surface 28. The contact surface 74 and bearing surface 28 may be nonparallel. In one embodiment, the angular relationship between the contact surface 74 and the wedge support block 20 may be equivalent and opposite to the support surface 34 of the base 16 such that when the wedge support block 20 is positioned on the base 16, the bearing surface 28 is generally orthogonal to the longitudinal axis 23 of the turbine airfoil 18. In such a position, the turbine vane 12 may be moved radially outward by moving the wedge support block 20 laterally relative to the base 16 or vice versa.

The wedge support block 20 may include a protrusion 76 that is positioned within a groove 78 in the base 18. The groove 78 may extend from the third side 66 of the base 18 between the first and second sides 58, 62. The protrusion 76 may include an orifice 80 for receiving the bolt 24. The orifice 80 may be threaded to receive a threaded bolt 24.

Figure 8:
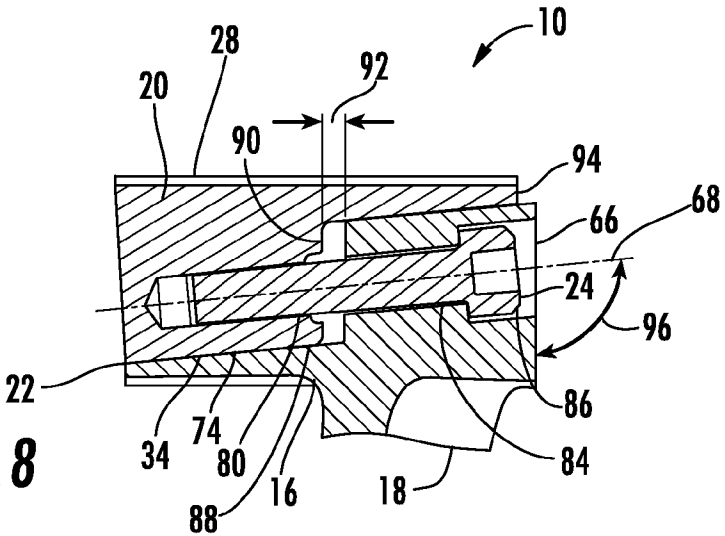
FIG. 8 is a detail view taken at detail 8 in FIG. 7.

In one embodiment, the contact surface 74 of the wedge support block 20 and the protrusion 76 both contact the base 16 on the support surface 34 and another surface 88 parallel to the support surface 34 forming the bottom of the groove 78. As shown in FIG. 8, the base 16 may be configured such that the gap 92 between the side surface 90 of the protrusion 76 and the base 16 is greater than a distance between an outer side surface 94 of the wedge support block 20 and the fourth side 66 of the base 16. In such a configuration, the wedge support block 20 may be moved laterally relative to the base 16 until the outer side surface 94 of the wedge support block 20 is flush with the base 16 without limitation of the protrusion 76 of the wedge support block 20.

The turbine vane attachment system 10 may include a connection system 82 that movably engages the wedge support block 20 to the base 16 such that the wedge support block 20 is movable relative to the base 16. As such, the connection system 82 may increase a distance between the outer bearing surface 28 of the base and the channels 56, 60 thereby causing the wedge support block 20 and base 16 to be fixed tightly to tongues 32 extending from a vane carrier 14 into the first and second channels 56, 60 of the base 16 such that rotation about the connection system 82 is prevented and movement of the turbine airfoil 18 and base 16 relative to the vane carrier 14 is prevented.

Figure 7:
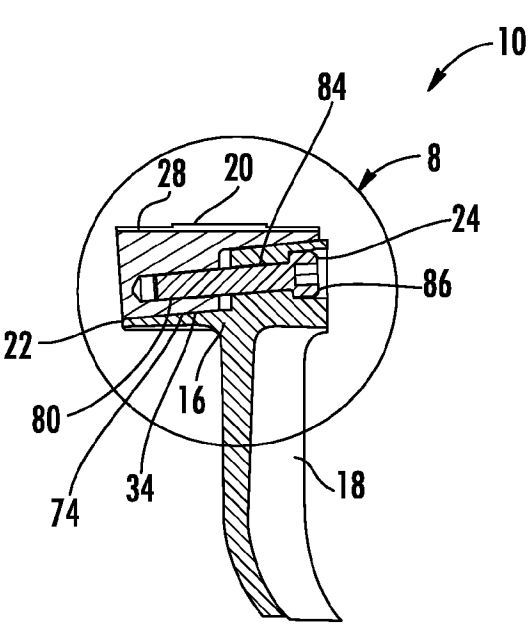
FIG. 7 is a cross-sectional view of the turbine blade taken at section line 6-6 in FIG. 6.
Figure 6:
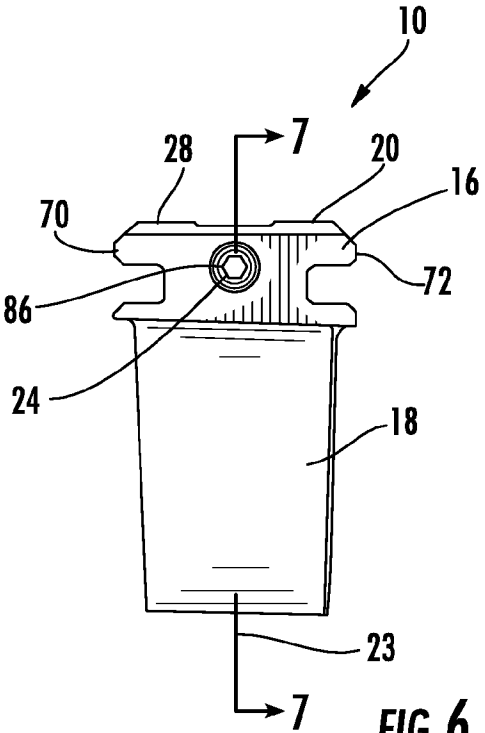
FIG. 6 is a side view of the turbine vane of this invention.

In at least one embodiment, the connection system 10 may include at least one bolt 24 extending through an orifice 84 in the base 16 and threadably attached in an orifice 80 in the wedge support block 20. The head 86 of the bolt 24 may be countersunk in the base 16. As shown in FIG. 6, the bolt 24 may be positioned on a longitudinal axis 23 of the turbine airfoil 18. As shown in FIGS. 7 and 8, the bolt 24 may be parallel with the support surface 34 of base 16, which facilitates easy movement of the wedge support block 20.

During use, the turbine vane 12 may be positioned in a turbine vane carrier 14 by inserting the base 16 into the turbine vane carrier 14 such that the tongues 32 extending from the turbine vane carrier 14 are received within the first and second channels 56, 60. The connection system 82 may be used to move the wedge support block 20 relative to the base 16. In one embodiment in which the connection system 82 includes the bolt 24, the bolt 24 may be rotated to draw the wedge support block 20 laterally along the base 16. Such movement increases a distance between the outer bearing surface 28 and the first and second channels 56, 60 and causes the base 16 to become affixed to the turbine vane carrier 14 whereby movement of the turbine vane 12 relative to the turbine vane carrier 14 is prevented.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine vane attachment system, comprising:

a generally elongated airfoil formed from an outer wall, and having a leading edge, a trailing edge, a pressure side, a suction side, a first endwall at a first end, a second endwall at a second end opposite the first end;

a base extending radially from the generally elongated airfoil, including an outer surface proximate to the airfoil, and including a first channel extending into a first side of the base that is generally orthogonal to the generally elongated airfoil and a second channel extending into a second side of the base generally opposite to the first side and generally aligned with the first channel;

a first flange aligned with and forming a side of the first channel;

a second flange aligned with and forming a side of the second channel;

a support surface on the base that is radially remote to the generally elongated airfoil and nonparallel to the generally elongated airfoil;

a wedge support block having a contact surface in contact with the support surface of the base and an opposite bearing surface, wherein the contact surface and bearing surface are nonparallel;

wherein a protrusion of the wedge support block is positioned within a groove in the base that extends from a third side of the base between the first and second sides;

a connection system movably engages the wedge support block to the base such that the wedge support block is movable relative to the base, which increases a distance between the outer bearing surface of the base and the channels thereby causing the wedge support block and base to be fixed tightly to tongues extending from a vane carrier into the first and second channels of the base such that rotation about the connection system is prevented and movement of the turbine airfoil and base relative to the vane carrier is prevented.

2. The turbine vane attachment system of claim 1, wherein the connection system comprises at least one bolt extending through an orifice in the base and threadably attached in an orifice in the wedge support block.

3. The turbine vane attachment system of claim 2, wherein a head of the bolt is countersunk in the base.

4. The turbine vane attachment system of claim 2, wherein the at least one bolt is positioned on a longitudinal axis of the turbine airfoil.

5. The turbine vane attachment system of claim 1, wherein the at least one bolt is parallel with the support surface of base.

6. The turbine vane attachment system of claim 5, wherein the at least one bolt is positioned at an angle between a longitudinal axis of the at least one bolt and a fourth side of the base that is generally opposite to the third side of the base, wherein the angle is between about ninety four degrees and ninety eight degrees.

7. The turbine vane attachment system of claim 6, wherein the angle is about ninety six degrees.

8. The turbine vane attachment system of claim 1, wherein the contact surface of the wedge support block and the protrusion both contact the base on the support surface and another surface parallel to the support surface.

9. A turbine vane attachment system, comprising:

a generally elongated airfoil formed from an outer wall, and having a leading edge, a trailing edge, a pressure side, a suction side, a first endwall at a first end, a second endwall at a second end opposite the first end;

a base extending radially from the generally elongated airfoil, including an outer surface proximate to the airfoil, and including a first channel extending into a first side of the base that is generally orthogonal to the generally elongated airfoil and a second channel extending into a second side of the base generally opposite to the first side and generally aligned with the first channel;

wherein the first and second channels are laterally offset from the generally elongated airfoil;

a first flange aligned with and forming a side of the first channel;

a second flange aligned with and forming a side of the second channel;

a support surface on the base that is radially remote to the generally elongated airfoil and nonparallel to the generally elongated airfoil;

a wedge support block having a contact surface in contact with the support surface of the base and an opposite bearing surface, wherein the contact surface and bearing surface are nonparallel;

wherein a protrusion of the wedge support block is positioned within a groove in the base that extends from a third side of the base between the first and second sides;

a connection system movably engages the wedge support block to the base such that the wedge support block is movable relative to the base, which increases a distance between the outer bearing surface of the base and the channels;

wherein the connection system is formed from at least one bolt extending through an orifice in the base and threadably attached in an orifice in the wedge support block thereby causing the wedge support block and base to be fixed tightly to tongues extending from a vane carrier into the first and second channels of the base such that rotation about the connection system is prevented and movement of the turbine airfoil and base relative to the vane carrier is prevented.

10. The turbine vane attachment system of claim 9, wherein a head of the bolt is countersunk in the base.

11. The turbine vane attachment system of claim 9, wherein the at least one bolt is positioned on a longitudinal axis of the turbine airfoil.

12. The turbine vane attachment system of claim 9, wherein the at least one bolt is parallel with the support surface of base.

13. The turbine vane attachment system of claim 12, wherein the at least one bolt is positioned at an angle between a longitudinal axis of the at least one bolt and a fourth side of the base that is generally opposite to the third side of the base, wherein the angle is between about ninety four degrees and ninety eight degrees.

14. The turbine vane attachment system of claim 13, wherein the angle is about ninety six degrees.

15. The turbine vane attachment system of claim 9, wherein the contact surface of the wedge support block and the protrusion both contact the base on the support surface and another surface parallel to the support surface.

* * * * *